US008915792B2

(12) United States Patent
Coucher et al.

(10) Patent No.: US 8,915,792 B2
(45) Date of Patent: Dec. 23, 2014

(54) GOLF SWING TRAINING AID AND METHOD

(71) Applicant: GSI Universal, LLC, North Plains, OR (US)

(72) Inventors: Robert J. Coucher, North Plains, OR (US); Gigi D. M. Senecal, Portland, OR (US)

(73) Assignee: GSI Universal, LLC, North Plains, OR (US)

( * ) Notice: Subject to any disclaimer, the term of this patent is extended or adjusted under 35 U.S.C. 154(b) by 0 days.

(21) Appl. No.: 14/151,709

(22) Filed: Jan. 9, 2014

(65) Prior Publication Data

US 2014/0221116 A1 Aug. 7, 2014

Related U.S. Application Data

(60) Provisional application No. 61/761,269, filed on Feb. 6, 2013.

(51) Int. Cl.
*A63B 69/36* (2006.01)

(52) U.S. Cl.
CPC ..... *A63B 69/3614* (2013.01); *A63B 69/3632* (2013.01)
USPC ..... 473/220; 473/409

(58) Field of Classification Search
CPC ..... A63B 69/3614; A63B 69/3685; A63B 69/3676; A63B 2207/02; A63B 69/36; A63B 24/0021
USPC ..... 473/220, 223, 226, 409
See application file for complete search history.

(56) References Cited

U.S. PATENT DOCUMENTS

| | | | | |
|---|---|---|---|---|
| 3,953,034 | A | 4/1976 | Nelson | |
| 4,456,257 | A * | 6/1984 | Perkins | 473/220 |
| 4,898,389 | A | 2/1990 | Plutt | |
| 5,082,282 | A * | 1/1992 | Hernberg | 473/220 |
| 5,277,428 | A | 1/1994 | Goodwin et al. | |
| 5,482,283 | A | 1/1996 | Wall | |
| 5,542,676 | A | 8/1996 | Howe, Jr. et al. | |
| 5,788,588 | A * | 8/1998 | Hooker | 473/409 |
| 5,873,789 | A * | 2/1999 | Torriano | 473/220 |
| 5,897,441 | A * | 4/1999 | Apthorp | 473/220 |
| 5,924,934 | A | 7/1999 | Hamilton | |
| 6,224,493 | B1 | 5/2001 | Lee et al. | |
| 6,254,493 | B1 * | 7/2001 | Wurster | 473/220 |
| 6,277,030 | B1 | 8/2001 | Baynton et al. | |
| 6,302,802 | B1 | 10/2001 | Pao | |
| 6,468,167 | B1 | 10/2002 | Florian | |
| 6,488,592 | B1 * | 12/2002 | Boatner | 473/220 |
| 6,921,340 | B2 * | 7/2005 | Dickie | 473/220 |
| 2004/0023726 | A1 | 2/2004 | Ritson et al. | |
| 2005/0202894 | A1 | 9/2005 | Finney et al. | |
| 2011/0224012 | A1 | 9/2011 | Hashimoto et al. | |
| 2013/0090179 | A1 | 4/2013 | Davenport | |

* cited by examiner

*Primary Examiner* — Nini Legesse
(74) *Attorney, Agent, or Firm* — James F. Hann; Haynes Beffel & Wolfeld LLP

(57) ABSTRACT

A golf swing training club includes a golf club, with a shaft, a grip and a club head, and a golf swing training aid, with a light beam generator along the shaft placeable in an on state to generate inside and outside light beams directed towards inside and outside positions corresponding to the head and toe of the club head. A golfing stroke can be executed over a surface so that the paths of the inside and outside light beams along the surface can be observed during the golfing stroke. A second light beam can be generated generally parallel to the shaft and away from the club head; the path of the second light beam along the surface can also be observed during a back-swing portion of the golfing stroke.

23 Claims, 4 Drawing Sheets

GOLF SWING TRAINING AID AND METHOD

CROSS-REFERENCE TO OTHER APPLICATIONS

This application claims the benefit of U.S. provisional patent application No. 61/761,269, filed on 6 Feb. 2013, entitled Swung Implement with Educating Feedback.

BACKGROUND OF THE INVENTION

A great amount of time and energy has been expended in the pursuit of training techniques, training devices and training aids to help sports enthusiasts, in particular golfers and tennis players and to a lesser extent baseball players and fly fishers, improve their swings and strokes. Although the equipment continues to improve, such as metal woods for golfers and graphite rods for fly fishers, to some extent these improvements have merely increased what is generally considered a basic level of competence in a particular sport. Therefore sports enthusiasts continue to look for ways to improve their skills.

BRIEF SUMMARY OF THE INVENTION

An example of a golf swing training aid is positionable along the shaft of a golf club. The golf club has a club head at a distal end of the shaft, the club head having a striking face extending between a heel and a toe of the club head. The training aid includes a housing and a light beam generator carried by the housing. The light beam generator is placeable in an on state to generate inside and outside light beams directable towards inside and outside positions corresponding to the heel and toe of the club head as the golf club is swung during a golfing stroke. Examples of the golf swing training aid can include one or more the following. The housing can be removably mountable to a golf club shaft or can be an integral portion of the golf club shaft. The light beam generator can include a laser light source. The inside and outside light beams can be oriented to be directed along paths forward of the striking face of the club head. The light beam generator can generate a second light beam directed generally parallel to the shaft and away from the club head.

An example of a golf swing training club includes a golf club and a golf swing training aid. The golf club has a shaft with a distal and proximal ends, a grip at the proximal end, and a club head at the distal end. The club head has a striking face extending between a toe and a heel of the club head. The golf swing training aid includes a light beam generator along the shaft. The light beam generator is placeable in an on state to generate inside and outside light beams directed towards inside and outside positions corresponding to the head and toe of the golf club head as the golf club is swung during a golfing stroke. In some examples the light beam generator can generate a second light beam directed generally parallel to the shaft and away from the club head.

An example of a method for improving the golf club swinging motion of a golfer is carried out as follows. A golf swing training club is accessed. The golf swing training club includes a golf club and a golf swing training aid. The golf club has a shaft with distal and proximal ends, a club head at the distal end, and a grip at the proximal end. The club head has a striking face extending between a toe and a heel of the club head. The golf swing training aid has a light beam generator along the shaft. Inside and outside light beams are generated by the light beam generator, the light beams being directed towards inside and outside positions corresponding to the heel and toe of the club head as the golf club is swung during a golfing stroke. A golfing stroke is executed over a surface using the golf swing training club. The paths of the inside and outside light beams along the surface are observed during the golfing stroke. This method can be carried out to include one or more the following. The method can further comprise placing a golf ball on the surface and striking the golf ball with the striking face of the club head during the golfing stroke. The paths observing step can include determining the locations of the paths relative to the golf ball. The paths observing step can include determining the orientation of the striking face of the club head relative to the golf ball. The light beams generating step can be carried out so that the inside and outside light beams are directed in front of the striking face. The method can also include generating a second light beam generally parallel to the shaft and away from the club head, and observing the path of the second light beam along the surface during a backswing portion of the golfing stroke.

Other features, aspects and advantages of the present invention can be seen on review of the drawings, the detailed description, and the claims which follow.

DETAILED DESCRIPTION OF THE INVENTION

Figure 2:
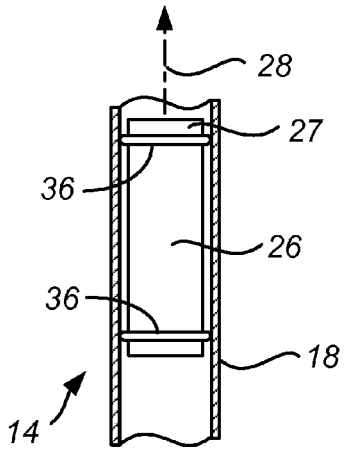
FIG. 2 is a view in section of the golf swing training aid within the grip of the golf club of FIG. 1.

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Unless otherwise stated, in this application specified relationships, such as parallel to, aligned with, or in the same plane as, mean that the specified relationships are within limitations of manufacturing processes and within manufacturing variations. When components are described as being coupled, connected, being in contact or contacting one another, they need not be physically directly touching one another unless specifically described as such. Like elements in various embodiments are commonly referred to with like reference numerals.

The invention may be embodied in various shapes and forms to various devices or implements that require a user to make a precise swinging motion of the device or implement. Preferred embodiments provide feedback to a user to facilitate education of the user, thereby permitting the user to achieve a desired swing. Desirably, the education process afforded by an embodiment of the instant invention causes faster and/or more complete progress toward mastering a swing than achievable with currently available and conventional training.

Figure 1:
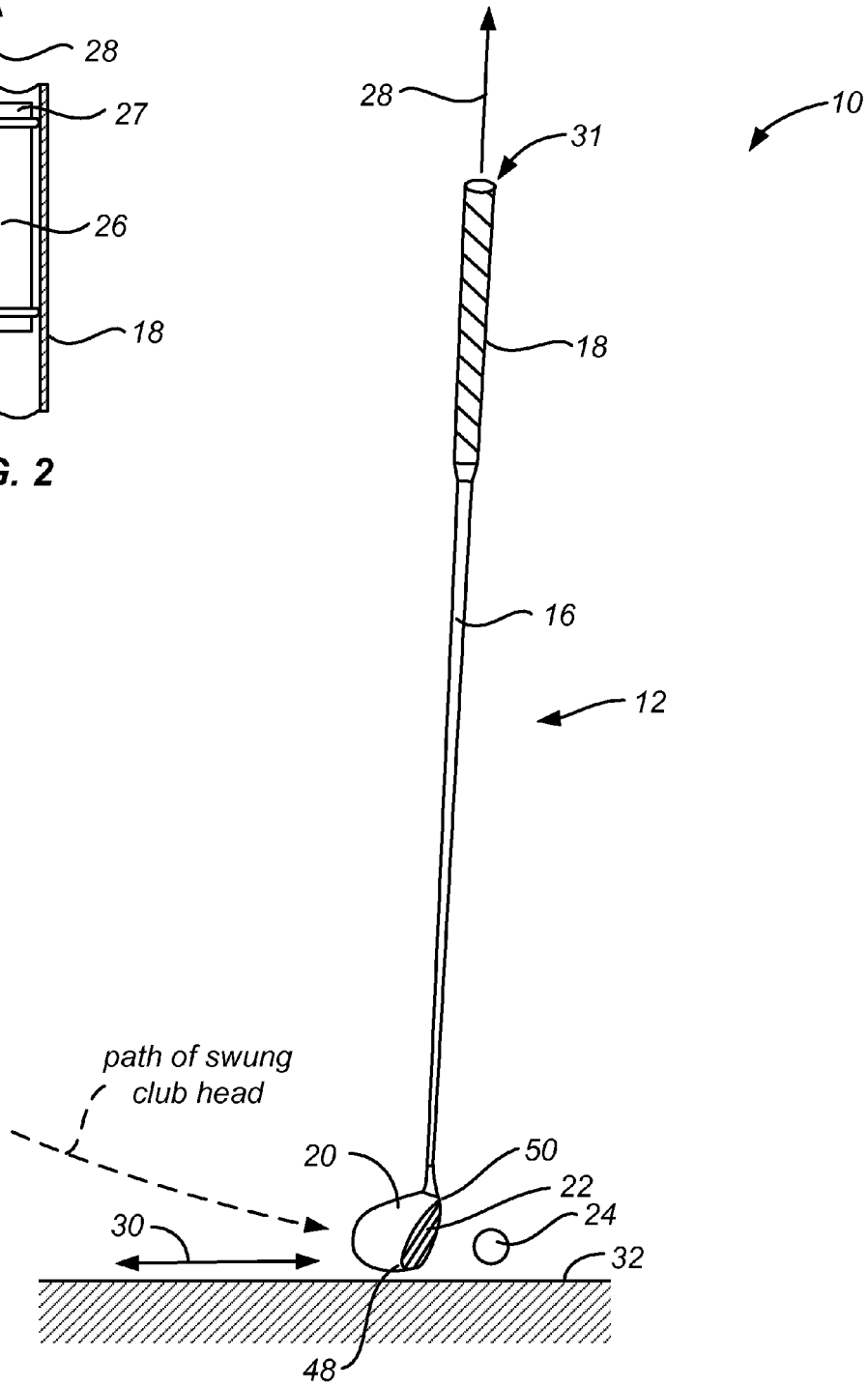
FIG. 1 is a view of a first example of a golf swing training club.

FIG. 1 illustrates a first example of a golf swing training club 10 adapted to provide learning feedback for the swinger of a golf club. The training club 10 in FIG. 1 includes a golf club 12 and a golf swing training aid 14. Golf club 12 includes a shaft 16 having a grip 18 at its proximal end and a club head 20 at its distal end. Club head 20 has a striking face 22 for striking a golf ball 24 during a golfing stroke. Golf swing training aid 14 includes a light source and battery assembly 26 housed within grip 18 as shown in FIG. 2. Assembly 26 includes a light source 27, typically a laser source 27, adapted to extend a light beam 28, commonly referred to as laser beam 28, aligned with the axis of shaft 16, and propagating away from the club head 20 through a window 31 at the proximal ends of shaft 16 and grip 18. Preferably, the laser propagates co-linearly with the central axis of the club shaft.

The laser beam 28 paints a laser beam path 30 on the ground 32 as the golfer makes a swing. At the top of the swing, the laser beam 28 is pointing almost directly at the ball 24. The golfer can observe the laser beam path 30 during the backswing and can ascertain whether or not the backswing is staying in the proper swing plane. Also, as the golfer begins the stroke to impact, the golfer can see whether or not the club remains in the proper plane. If it does, the laser beam 28 will trace an overlapping arc shape on the backswing and downstroke. Further, the arc, or an extension of the arc, should pass approximately or actually through the ball.

A laser type light source 27 is currently preferred for use in generating light beam 28 to provide visual feedback to the user, due to the high visibility of commercially available, low cost, red laser beams. Therefore, the light source 27 of assembly 26 will generally be referred to as a laser, although other light sources are not excluded.

One way to provide a laser in association with a golf club is illustrated in FIG. 2, where laser and battery assembly 26 is structured to be carried inside the grip 18 of the club 12. Positioning of the assembly 26 may be made by removing a grip end-cap, and sliding the assembly along the inner shaft of the grip to a desired installed position. Gripping structure, such as one or more illustrated O-rings 36, may be employed in compression to hold the assembly 26 at the desired position. Certain structure, e.g. for recharging the battery, removing the assembly, and details of the window, are not illustrated, being well within the capability of one of ordinary skill to construct. Alternative arrangements are within contemplation, including structuring a laser assembly as one or more add-on module that may be coupled with a commercially available golf club.

By observing the projected light beam's impingement on the surface 32 on which a target golf ball 24 rests before, during and after a golf stroke, the user gets immediate visual feedback regarding the path of the club with respect to a target ball. This feedback is beneficial in ensuring proper backswing, proper backswing positioning at its apex, and proper swing path through the swing plane, and proper finish to the golf stroke.

Figure 3:
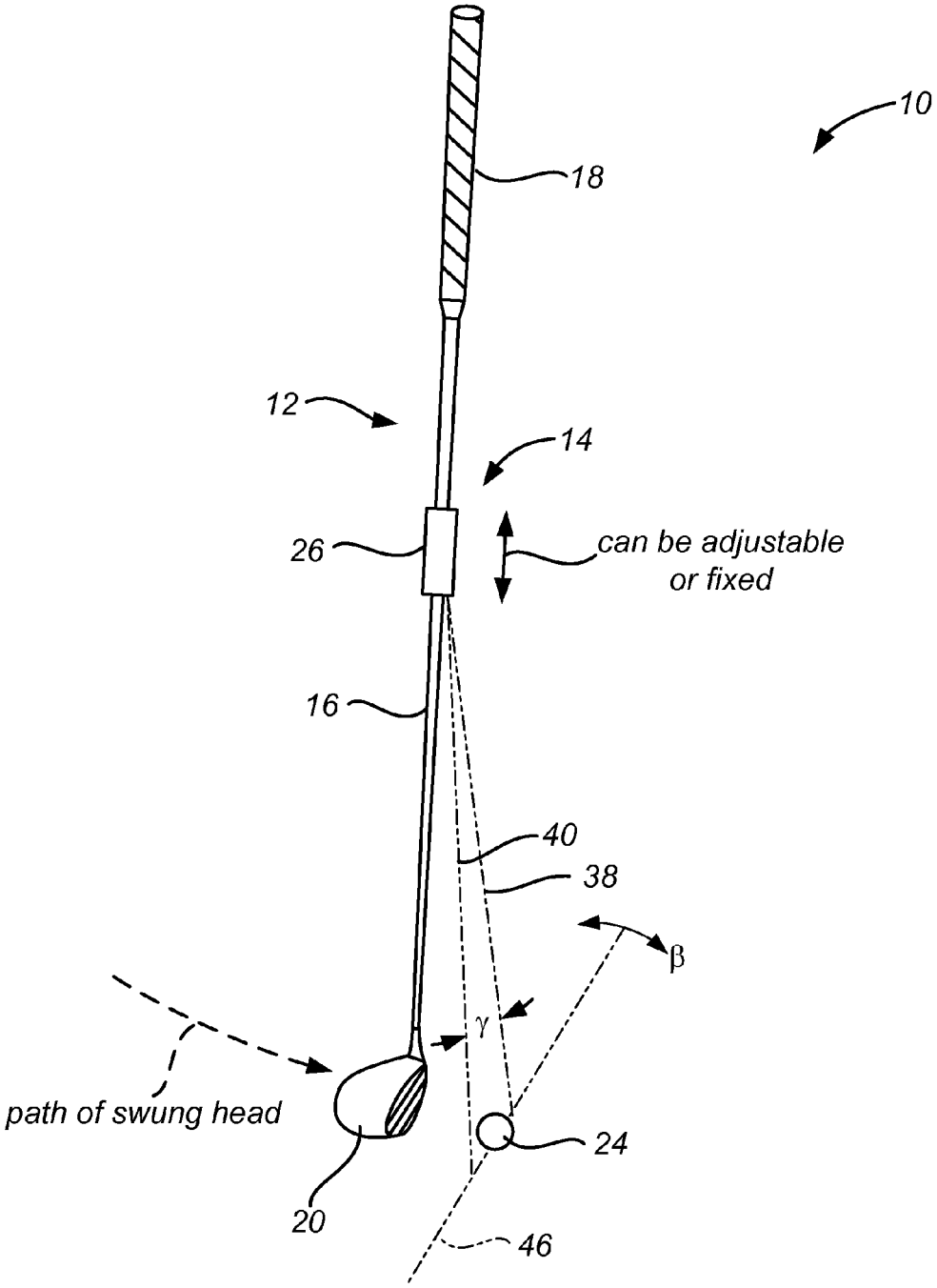
FIG. 3 is a view of a second example of a golf swing training club generating inside and outside, downward extending light beams.

FIG. 3 illustrates a second example of a golf swing training club 10 in which golf swing training aid 14 is an add-on module that may be coupled with a commercially available golf club 12. In the illustrated example, golf swing training aid 14 attaches to the approximate mid-shaft of a golf club 12, and includes an attachment mechanism, a light source 27 (e.g., a laser source 27), a pair of light beams, generally referred to as inside laser beam 38 and outside laser beam 40, and an adjustable component which allows the beams to be projected down in front of the club striking face 22 an arbitrary (and desirably selectable) distance in front of the club striking face 22. In a preferred embodiment, the assembly 26 is as light as possible so that it minimally affects club performance. Also, the attachment mechanism preferably holds the device rigidly in place at the club shaft's center of percussion.

Figure 5:
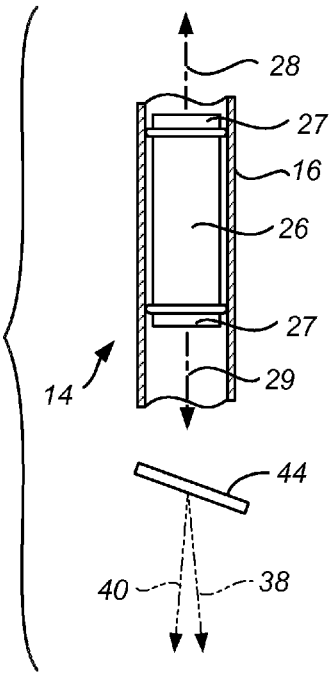
FIG. 5 is a schematic view in section of a golf swing training aid within the shaft of the golf club of FIG. 4.

The pair of laser beams 38, 40 may be provided from a cost-effective single laser source 27 by way of fiber optic cables, one or more lens, or an angularly variable beam splitter, such as beam splitter 44 shown in FIG. 5. Desirably, the spacing between inside and outside laser beams 38, 40 is adjustable, as indicated by $\gamma$. A preferred device permits positioning the two beams to straddle a golf ball that is disposed at the sweet spot in the club head's striking face 22. Also, it is preferred for the line 46 defined between the projected beams 38, 40 to be adjustable relative to the striking face, as indicated by $\beta$.

When the club is moved through the golf stroke, the split beams 38, 40 pass on both sides of the ball 24 before the club face 22 impacts the ball. The beams 38, 40 are positioned such that they provide immediate visual feedback regarding club face position, whether open, closed, or perpendicular to the swing path, at the moment of impact, allowing the golfer to make swing adjustments for the purpose of addressing hooking or slicing or desired fade or draw. The beams 38, 40 also enable the golfer to observe where the club face 22 strikes the ball 24 (i.e., toe 48, center, heel 50) and make appropriate adjustments to addressing and stance.

Figure 4:
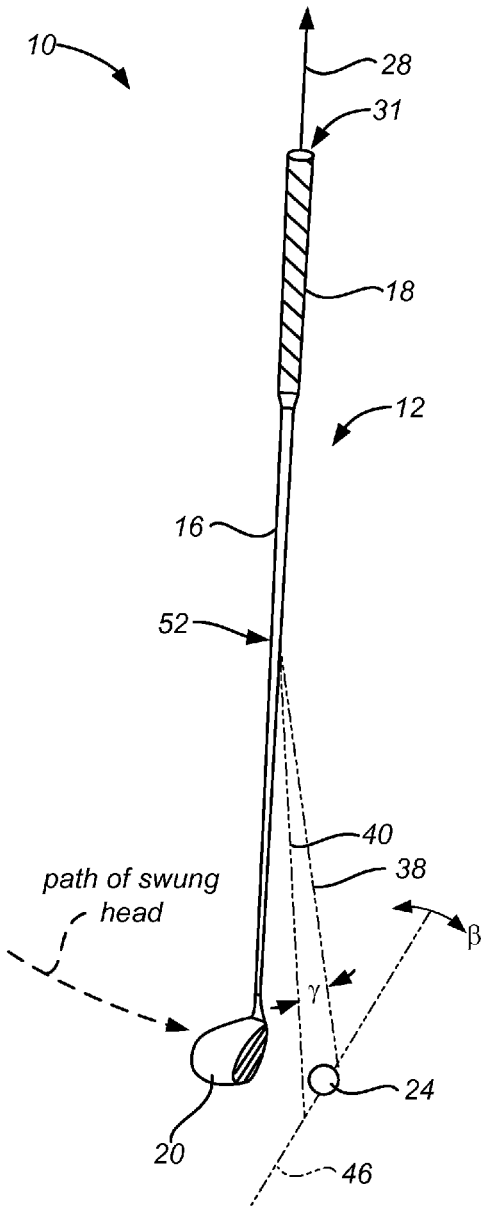
FIG. 4 is a view of a third example of a golf swing training club in which inside and outside, downward extending light beams emanate from the central portion of the shaft of the golf club.

A third example is illustrated in FIGS. 4 and 5 and may combine one or more selected aspects contained in both of FIGS. 1 and 3. Assembly 26 is constructed to create the laser beam 28 extending away from club head 20 and a second laser beam 29-generally towards the club head. Laser beam 29 is transformed into inside and outside laser beams 38, 45 beam splitter 44. An aperture 52 in the club shaft 16 may be provided as an alternative way to permit projecting the laser beams 38, 40 from a propagation location inside the club shaft. Alternatively, an aperture may be provided at the area of handle-to-shaft junction. The assembly 26 illustrated in FIG. 5 may be disposed inside the grip 18 or at any desired position along the shaft 16. Since certain components, such as a battery, necessarily adds some weight (and mass), it is sometimes preferable to dispose the assembly 26 inside the grip 18 to minimize change in club response due to inclusion of one or more feed-back devices. Fiber optic cables may be used to advantage to route an interior beam through the wall of the club shaft 16 at a location that reduces reduction of structural integrity of the shaft (e.g., through the larger-diameter shaft near/inside the grip 18). A pair of such cables may be employed to split and orient direction of propagation of a beam from a single laser source 27.

The examples illustrated in FIGS. 1, 3 and 4 provide only visual feedback to the golfer. The embodiment illustrated in FIGS. 6 and 7 may include none, or any one or more of the aspects illustrated in FIGS. 1, 3 and 4, and also provide additional feedback to a user of the golf club. In addition to potentially including one or more visual feedback arrangements, the embodiment in FIGS. 6 and 7 includes one or more data acquisition transducers 56, a central processing unit (CPU) 58, and one or more feedback modules. Data acquisition transducers 56 within contemplation include accelerometers and gyroscopes, especially such transducers that are embodied as micro versions. A feedback module 60 may provide physical feedback (such as vibration) or audible feedback (such as a tone). A battery module 62 provides power for assembly 26. A charging/communication port 68 can be used to charge battery module 62 and to permit stored data to be downloaded.

Figure 6:
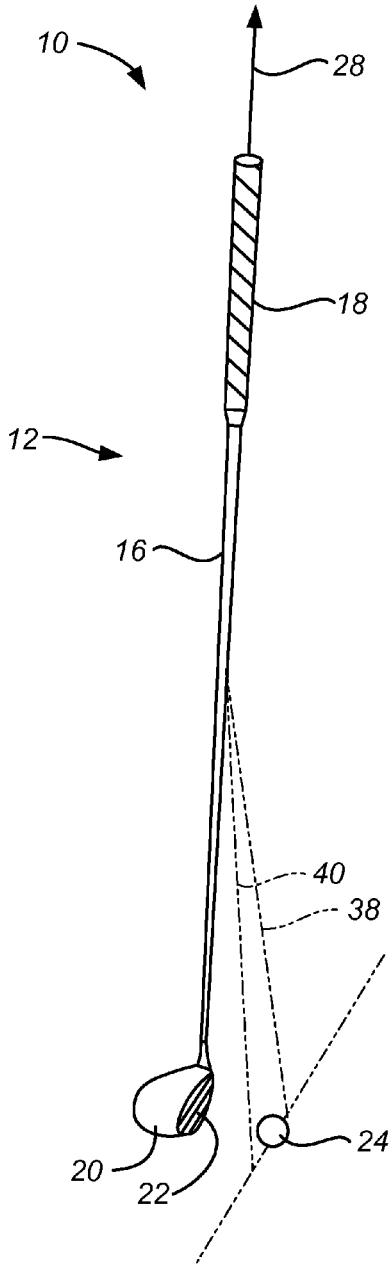
FIG. 6 is a view of a fourth example of a golf swing training club in which inside and outside, downward extending light beams emanate from the shaft of the golf club adjacent to the grip.
Figure 7:
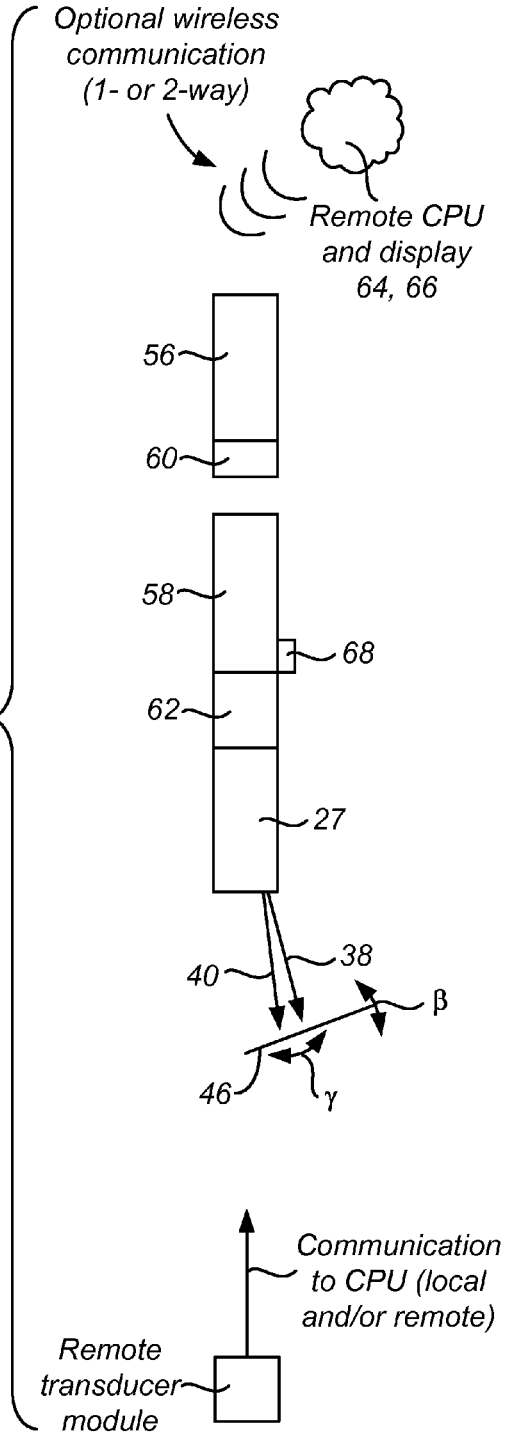
FIG. 7 is a schematic illustration showing various electronic components of the golf swing training club of FIG. 6.

The embodiment in FIGS. 6 and 7 includes as integral parts: a CPU 58, one or more micro-accelerometers, and/or micro-gyroscope transducers 56, and a feedback module 60 to provide tactile and/or audible feedback. Such components work together to provide the golfer immediate physical feedback as to the correctness of the golf stroke during the backswing, downswing and follow-through.

A tactile or audible feedback may be provided by one or more feedback modules 60, such as a vibrator. An operable vibrator may include an eccentric weight spun by a motor, similar to the vibrator of a cellular telephone. An audible feedback may be provided by a feedback module including a speaker, or other sound producing element. The audio feedback could be selected to be heard by anyone in the area as it emanates from the golf club 12 or training aid 14. In addition or alternatively, the audio feedback could be transmitted to an earpiece via Wi-Fi or other wireless transmission protocol. Providing the audio feedback only to an earpiece allows the feedback to be available only to one or more of the user, instructor or other third party.

Certain transducers 56, such as accelerometers and/or gyroscopes, may be located in the club 12 such that the relative speeds and positions of the club face 22, shaft 16 and grip 18 are continuously detected through the entire stroke sequence. The CPU 58 typically monitors these respective positions throughout the stroke sequence. If the stroke is executed properly, no tactile or audible feedback may be provided to the golfer. If, at any point in the stroke sequence, the relative speeds and positions of club face 22, shaft 16, and grip 18 depart from an acceptable and proper swing plane and swing motion, the CPU 58 may be programmed to instantly signal one or more feedback module to provide a selected sensation to the golfer. The golfer learns to avoid this sensation, and therefore more quickly develops a proper stroke sequence. The frequency and/or intensity of the vibrational feedback can be made to vary. For example, a high frequency and more intense vibration can be used to indicate a larger departure from the desired swing plane, tempo, etc. Similarly, the pitch and/or volume of an audible tone can made to vary according to the accuracy of the golf stroke.

The educating feedback provided by embodiments structured according to certain principles of the instant invention can be incorporated into wedges, irons, hybrid clubs, woods, and drivers, among other applications. The sensing and feedback system can generally be turned off or on at will by the golfer. The clubs can be used on practice ranges or on the course. The clubs can be used by the golfer alone, or with the assistance of golf pros or coaches. The technology is designed to be as unobtrusive to the clubs' performance as possible, such that they perform identically to similar clubs not incorporating the technology.

Desirably, a particular base-line, or "desired" swing for the golf club's CPU 58 is obtained, e.g., programmed with the use of heuristics; e.g., professional golfers could swing the clubs hundreds to thousands of times to create a "profile swing" typical of that golfer. Swing deviation boundaries will be established to trigger actuation of the feedback system. A user can potentially select the professional golfer's profile most appealing to them. (E.g., the "Bubba Watson" or the "Stacy Lewis" stroke profile). The CPU's firmware will typically be re-programmable so that a user can experiment with a variety of different professional stroke profiles to determine which profile is most suitable. For back swings, impact swings and follow-through, different tones can be generated to indicate to the user that the golfing stroke is, for example, inside, outside, high, or low relative to an ideal path. This provides the user additional information about what is necessary to correct the swing path. Nine fundamental full swing strokes, including straight, draw, and fade strokes, each selectable for low, medium, and high loft, can be user selectable by the user according to which stroke user wishes to practice.

It is within contemplation that an alternative embodiment of a golf club may include data acquisition transducer(s) 56 and a communication module 68. For communicating individual or average swing performance to a remote CPU 64 for swing evaluation. An associated display 66 may be used to provide the golfer with a rigorous printout detailing the specific area(s) of departure of a user's swing from a desired swing. An on-board memory module may be provided to store data related to one or more swing. Swing data may be uploaded on demand to the remote processing/display device by way of a communication protocol, including wired and wireless. An exemplary wired communication protocol includes micro-USB cable. An exemplary wireless communication protocol includes Bluetooth. Preferred embodiments of the invention may therefore allow a golfer to not only obtain real-time feedback in the course of each swing, but also enable later review for additional learning (e.g., consistent swing errors) and improvement.

In any case, a club may be programmed by having a professional golfer swing it many, many, times to create an "average" perfect swing in the style of "big name" pros, perhaps even an actual "big name" professional may perform the swinging. By virtue of the instrumentation recording many such strokes, the club may be programmed heuristically to note the preferred path and allowable departures from it within an arbitrarily assigned value. Specific departure values may have to be empirically determined by watching the flight path of the struck balls and correlated to each particular stroke, potentially for each individual user. The golfer can see the result of each ball strike to see what the problem(s) is and can alter subsequent swings accordingly. This is what is done anyway without instrumentation, but with additional feedback inculcation of muscle memory is accelerated. Heuristically derived swing patterns can be adjusted to allow arbitrarily larger or smaller deviations by the user. In this way a less experienced golfer can increase the allowable departure tolerance compared with a more refined and experienced golfer.

It is envisioned that a golf club with integrated technology according to certain aspects of the invention will be purchasable as single units. Retrofit kits may also be available to allow golfers to have their existing clubs equipped with the technology.

The instantaneous visual feedback afforded by certain golf-related embodiments of the invention helps beginning golfers more rapidly obtain proper mechanics of the entire stroke sequences for a variety of different golf strokes. It provides reinforcement to other visual, physical, and kinesthetic feedback to enhance and accelerate establishment of muscle memory for optimal stroke mechanics. It can help more advanced golfers isolate issues with their swing mechanics and correct defects correspondingly. The device can be used by the golfer alone, or it can be used as a coaching aid by golf professionals providing instruction. A device structured according to any of FIGS. 1, 3, 4, 6 and 7, can be used off the course, at driving ranges, or during actual play to maintain high awareness of stroke mechanics and consequences of specific variations from proper club head motion and positioning throughout the entire stroke sequence.

Embodiments according to certain aspects of the instant invention may be applied to other swung implements. For one non-limiting example, casting in fly fishing includes a timing element that is dependent on amount of line out. A fly rod embodiment of the invention may include one or more sensors adapted to detect proper amount of bending after a back cast (rod loading) before the front cast is initiated. Vibration of the grip if the front cast is started too soon would be a powerful teaching aide. Feedback if the fly fisher fails to maintain the rod in a plane (e.g., perhaps for distance casts) could be also. It is within contemplation that a laser could also have some sort of aiming benefit, and if the beam extends too far in front of you, you know your tip went too low on the back cast.

Desirably, the inclusion of the feedback-generating equipment according to preferred embodiments of the invention is effected in such a manner that it interferes minimally (or not at all) with proper use and swinging of the implement by the user. That is, the combination of feed-back generating equipment and an associated implement is desirably weighted and balanced such that the feedback-generating equipment has minimal interference with proper use and swinging of the implement.

It is within contemplation to include means to provide discontinuous output of a laser to avoid causing harm to any bystanders during use of an embodiment of the invention. For example, the laser may be shut off, or its emission path interrupted, under certain circumstances, such as if the beam would not normally contact the ground. As a non-limiting example, one or more on-board data acquisition sensor may be used as one way to provide feedback to a golf club control system effective to regulate laser output and provide a safety over-ride mechanism to resist unsafe laser emissions. One alternative includes a mechanical switch, such as a mercury switch, which only permits laser operation during a "safe" arc of club travel.

Desirably, certain embodiments of the invention will include a way to initiate implement response (e.g. tell a golf club to pay attention and prepare to evaluate a swing). That is, the user may provide an input that signals to an implement's control system that a swing is imminent. One potential such signal includes tapping an implement on the ground one or more times to turn the processing system on and prepare to receive and process a swing input. One or more of the on-board data acquisition transducers can provide an initiation signal based on ground-contact induced shock. An alternative includes permitting the user to "waggle" an (e.g. golf club-type) implement a few times (as is the warm-up custom of many golfers). Even a simple contact switch that is actuated by grasping an implement, such as by properly holding the grip of a golf club, may be employed in another variation to communicate initiation of a stroke to the control system.

It is contemplated that certain embodiments of the invention may be applied to any and/or all swung implements, whether in sports, industry, military applications, video gaming, and so on. For examples, but without limitation, embodiments of the invention may be applied to baseball bats, tennis racquets, cricket paddles, swords, epees, racquetball racquets, lacrosse sticks, hockey sticks, etc. In each application the utility of each aspect of the invention(s) (i.e., which sensors and feedback mechanisms, CPU, memory) would be evaluated and applied as appropriate. For example, use of light emitting feedback components may have little utility with an epee, but, may have applicability to hockey sticks. In many cases the use of micro triaxial accelerometers or micro gyros may be useful in conjunction with tactile or audible feedback mechanisms. Heuristic programming of the algorithms controlling feedback may have utility with many implements. For example, heuristically derived tennis swing patterns, for example backspin swings, fore spin swings or lob swings, can be adjusted to allow arbitrarily larger or smaller deviations by the user. In this way a less experienced tennis player can increase the allowable departure tolerance compared with a more refined and experienced tennis player. The ability to record through use of on board memory, for example, all of the swings of a tennis racquet in the course of a game, set, or match, may provide the user with substantial information to understand and enhance the learning process. Similarly, the use of transducers and audible and tactile feedback in an instrumented baseball bat, along with recording all swings in the course of a game or practice session for later analysis may have substantial utility, for example regarding the swing path of the bat, or timing of the users "wrist breaking".

The above descriptions may have used terms such as above, below, top, bottom, over, under, et cetera. These terms may be used in the description and claims to aid understanding of the invention and not used in a limiting sense.

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims. For example, various examples could include structure for selecting one or more of audio on/off, vibration on/off, light source 27 on/off.

Any and all patents, patent applications and printed publications referred to above are incorporated by reference.

What is claimed is:

1. A golf swing training aid positionable along the shaft of a golf club, the golf club having a club head at a distal end of the shaft, the club head having a striking face extending between a heel and a toe of the club head, the training aid comprising:

a housing;

a light beam generator carried by the housing and placeable in an on state to generate inside and outside light beams directable towards inside and outside positions corresponding to the heel and toe of the club head as the golf club is swung during a golfing stroke throughout the entire golfing stroke; and both of the inside and outside light beams being oriented to be directed along paths forward of the striking face of the club head.

2. The golf swing training aid according to claim 1, wherein the housing is removably mountable to a golf club shaft.

3. The golf swing training aid according to claim 1, wherein a portion of the golf club shaft constitutes the housing, and the light beam generator is located within the portion of the golf club shaft.

4. The golf swing training aid according to claim 1, wherein the light beam generator comprises a laser light source.

5. The golf swing training aid according to claim 1, wherein the light beam generator generates a further light beam directed generally parallel to the shaft and away from the club head.

6. The golf swing training aid according to claim 1, wherein the inside and outside light beams are directed along other than parallel light beam paths during the golfing stroke to define a non-zero included angle therebetween, the light beam paths being fixed relative to one another during the golfing stroke.

7. The golf swing training aid according to claim 6, wherein the light beam generator comprises a light-dividing device and a light-generating source generating a first light beam directed to the light-dividing device, the light-dividing device creating the inside and outside light beams from the first light beam.

8. A golf swing training aid positionable along the shaft of a golf club, the golf club having a club head at a distal end of the shaft, the club head having a striking face extending between a heel and a toe of the club head, the training aid comprising:

a housing;

a light beam generator carried by the housing and placeable in an on state to generate inside and outside light beams directable towards inside and outside positions corresponding to the heel and toe of the club head as the golf club is swung during a golfing stroke;

the light beam generator comprising a light-dividing device and a light-generating source generating a first light beam directed to the light-dividing device, the light-dividing device creating the inside and outside light beams from the first light beam.

9. The golf swing training aid according to claim 8, wherein the light-dividing device comprises a beam splitter.

10. A golf swing training aid positionable along the shaft of a golf club, the golf club having a club head at a distal end of the shaft, the club head having a striking face extending between a heel and a toe of the club head, the training aid comprising:

a housing;

a light beam generator carried by the housing and placeable in an on state to generate inside and outside light beams directable towards inside and outside positions corresponding to the heel and toe of the club head as the golf club is swung during a golfing stroke throughout the entire golfing stroke; and the inside and outside light beams being directed along other than parallel light beam paths during the golfing stroke to define a non-zero included angle therebetween, the light beam paths being fixed relative to one another during the golfing stroke.

11. A golf swing training club comprising:

a golf club comprising:

a shaft having a distal and proximal ends;

a grip at the proximal end; and a club head at the distal end of the shaft, the club head having a striking face extending between a toe and a heel of the club head;

a golf swing training aid comprising:

a light beam generator along the shaft;

the light beam generator placeable in an on state to generate inside and outside light beams directed towards inside and outside positions corresponding to the head and toe of the golf club head as the golf club is swung during a golfing stroke; and the light beam generator comprising a beam splitter and a light-generating source generating a first light beam directed to the beam splitter, the beam splitter creating the inside and outside light beams from the first light beam.

12. A golf swing training club comprising:

a golf club comprising:

a shaft having a distal and proximal ends;

a grip at the proximal end; and a club head at the distal end of the shaft, the club head having a striking face extending between a toe and a heel of the club head;

a golf swing training aid comprising:

a light beam generator along the shaft;

the light beam generator placeable in an on state to generate inside and outside light beams directed towards inside and outside positions corresponding to the head and toe of the golf club head as the golf club is swung during a golfing stroke throughout the entire golfing stroke; and both of the inside and outside light beams being oriented to be directed along paths forward of the striking face of the club head.

13. The golf swing training club according to claim 12, wherein the training aid is removably mountable to a golf club shaft.

14. The golf swing training club according to claim 12, wherein a part of the golf club shaft constitutes the housing, and the light beam generator is located within the portion of the golf club shaft.

15. The golf swing training club according to claim 12, wherein the inside and outside light beams define and an included angle therebetween.

16. The golf swing training club according to claim 12, wherein both of the inside and outside light beams are oriented to be directed along paths forward of the striking face of the club head.

17. The golf swing training club according to claim 12, wherein the light beam generator generates a further light beam directed generally parallel to the shaft and away from the club head.

18. A method for improving the golf club swinging motion of a golfer, comprising:

accessing a golf swing training club including golf club and a golf swing training aid, the golf club comprising a shaft having distal and proximal ends, a club head at the distal end, a grip at the proximal end, the club head having a striking face extending between a toe and a heel of the club head, the golf swing training aid comprising a light beam generator along the shaft;

generating, using the light beam generator, inside and outside light beams directed towards inside and outside positions corresponding to the heel and toe of the club head as the golf club is swung during a golfing stroke throughout the entire golfing stroke;

the light beams generating step being carried out so that both of the inside and outside light beams are directed in front of the striking face;

executing a golfing stroke over a surface using the golf swing training club; and observing the paths of the inside and outside light beams along the surface during the golfing stroke.

19. The method according to claim 18, further comprising placing a golf ball on the surface and striking the golf ball with the striking face of the club head during the golfing stroke.

20. The method according to claim 19, wherein the paths observing step comprises determining the locations of the paths relative to the golf ball.

21. The method according to claim 19, wherein the paths observing step comprises determining the orientation of the striking face of the club head relative to the golf ball.

22. The method according to claim 18, further comprising adjusting the directions of the inside and outside light beams.

23. The method according to claim 18, further comprising:

generating a further light beam generally parallel to the shaft and away from the club head; and observing the path of the further light beam along the surface during a backswing portion of the golfing stroke.

* * * * *